US007445050B2

(12) United States Patent
Kuttel et al.

(10) Patent No.: US 7,445,050 B2
(45) Date of Patent: Nov. 4, 2008

(54) TUBULAR RUNNING TOOL

(75) Inventors: B. Beat Kuttel, The Woodlands, TX (US); Brian C. Ellis, Spring, TX (US); S. Casimir Sulima, Spring, TX (US); Graham Lamb, The Woodlands, TX (US); Faisal J. Yousef, Houston, TX (US)

(73) Assignee: Canrig Drilling Technology Ltd., Magnolia, TX (US)

( * ) Notice: Subject to any disclaimer, the term of this patent is extended or adjusted under 35 U.S.C. 154(b) by 52 days.

(21) Appl. No.: 11/410,733

(22) Filed: Apr. 25, 2006

(65) Prior Publication Data

US 2007/0261857 A1 Nov. 15, 2007

(51) Int. Cl.
*E21B 19/16* (2006.01)

(52) U.S. Cl. ..... 166/380; 166/77.51

(58) Field of Classification Search ..... 166/380, 166/77.51, 85.1, 98; 175/52, 85; 414/22.71, 414/23, 745.4, 746.5
See application file for complete search history.

(56) References Cited

U.S. PATENT DOCUMENTS

| | | | | |
|---|---|---|---|---|
| 1,829,760 | A * | 11/1931 | Santiago | 294/86.22 |
| 2,178,999 | A | 11/1939 | Scott | |
| 2,775,304 | A | 12/1956 | Zandmer | |
| 3,540,533 | A | 11/1970 | Morrill | |
| 3,543,847 | A | 12/1970 | Haeber | |
| 4,114,404 | A | 9/1978 | Phelps | |
| 4,444,252 | A | 4/1984 | Fisher | |
| 4,448,255 | A | 5/1984 | Shaffer et al. | |
| 4,643,472 | A * | 2/1987 | Schukei et al. | 294/94 |
| 4,811,784 | A | 3/1989 | Theiss | |
| 4,971,146 | A | 11/1990 | Terrell | |
| 5,082,061 | A | 1/1992 | Dollison | |
| 5,125,148 | A * | 6/1992 | Krasnov | 29/426.6 |
| 5,330,002 | A | 7/1994 | Saunders | |
| 5,484,222 | A * | 1/1996 | Schulze-Beckinghausen | 403/307 |
| 5,553,667 | A | 9/1996 | Budde et al. | |

(Continued)

FOREIGN PATENT DOCUMENTS

GB 21555577 9/1985

(Continued)

OTHER PUBLICATIONS

Det Norske Veritas, Technical Report: BSW Limited design & engineering: testing of ballgrab anchor connector, report No. 2002-3263, Date: Jul. 31, 2002, publisher: Det Norske Veritas, http://www.ballgrab.co.uk/downloads/dnvfatiguereport.pdf.*

*Primary Examiner*—David J. Bagnell
*Assistant Examiner*—Cathleen R Hutchins
(74) *Attorney, Agent, or Firm*—Haynes and Boone LLP

(57) ABSTRACT

An apparatus is disclosed for handling a tubular segment, coupling the tubular segment with a tubular string, and handling the tubular string in a well bore. The apparatus has a tubular engagement assembly, which connects to a drive shaft of a top drive. The tubular engagement assembly has a self-engaging ball and taper assembly that releasably engages the tubular segment. When the tubular engagement assembly connects to the drive shaft and the ball and taper assembly engages the tubular segment, any rotation in the drive shaft results in rotation of the tubular segment. This rotation allows the tubular segment to engage the tubular string.

28 Claims, 6 Drawing Sheets

U.S. PATENT DOCUMENTS 5,749,585 A 5/1998 Lembcke
5,967,477 A * 10/1999 Walmsley ..... 248/230.2
6,302,199 B1 10/2001 Hawkins et al.
6,305,649 B1 10/2001 Walmsley et al.
6,352,115 B1 * 3/2002 Mathieu ..... 166/352
6,354,372 B1 3/2002 Carisella et al.
6,443,241 B1 9/2002 Juhasz et al.
6,536,520 B1 3/2003 Snider et al.
6,550,128 B1 4/2003 Lorenz
6,557,641 B2 5/2003 Sipos et al.
6,609,573 B1 8/2003 Day
6,622,796 B1 9/2003 Pietras
6,622,797 B2 9/2003 Sivley, IV
6,637,526 B2 10/2003 Juhasz et al.
6,688,398 B2 2/2004 Pietras
6,691,776 B2 2/2004 Guillory et al.
6,705,405 B1 3/2004 Pietras
6,719,063 B2 4/2004 Adams et al.
6,742,596 B2 6/2004 Haugen
6,752,569 B2 6/2004 Emmett
6,854,515 B2 2/2005 Matthews et al.
6,857,483 B1 2/2005 Dirks et al.
6,913,096 B1 7/2005 Nielsen et al.
6,920,926 B2 7/2005 York et al.
6,938,709 B2 9/2005 Juhasz et al.
6,966,385 B2 11/2005 Hemphill et al.
6,976,298 B1 12/2005 Pietras
6,991,265 B2 1/2006 Walmsley et al.
7,137,454 B2 11/2006 Pietras
7,140,443 B2 11/2006 Beierbach et al.
7,191,840 B2 3/2007 Pietras et al.
2001/0042625 A1 11/2001 Appleton
2002/0000333 A1 * 1/2002 Cicognani ..... 175/85
2002/0070027 A1 6/2002 Ohmer et al.
2002/0074132 A1 * 6/2002 Juhasz et al. ..... 166/380
2002/0107020 A1 8/2002 Lee
2002/0162665 A1 11/2002 Adams et al.
2002/0189817 A1 12/2002 Davidson et al.
2003/0000708 A1 1/2003 Coone
2003/0000742 A1 1/2003 Juhasz et al.
2003/0019636 A1 1/2003 Robichaux
2003/0066654 A1 4/2003 Juhasz et al.
2003/0098155 A1 5/2003 Walser et al.
2003/0127222 A1 7/2003 Marcin et al.
2003/0155154 A1 8/2003 Oser
2003/0173073 A1 9/2003 Snider et al.
2003/0183396 A1 10/2003 Adams et al.
2003/0196791 A1 10/2003 Dunn et al.
2003/0221842 A1 12/2003 Hayes et al.
2003/0226660 A1 12/2003 Winslow et al.
2004/0011531 A1 1/2004 Pietras
2004/0035572 A1 2/2004 Cooper
2004/0069500 A1 4/2004 Haugen
2004/0084191 A1 5/2004 Laird
2004/0094957 A1 * 5/2004 Walmsley et al. ..... 285/307
2004/0149451 A1 8/2004 Pietras
2004/0173357 A1 9/2004 Pietras
2004/0182611 A1 9/2004 Ramey et al.
2004/0216924 A1 * 11/2004 Pietras et al. ..... 175/57
2004/0256110 A1 * 12/2004 York et al. ..... 166/379
2005/0000691 A1 * 1/2005 Giroux et al. ..... 166/291
2005/0000696 A1 1/2005 McDaniel et al.
2005/0061548 A1 3/2005 Hooper et al.
2006/0005962 A1 1/2006 Juhasz et al.
2006/0102337 A1 5/2006 Elliot et al.
2006/0249292 A1 11/2006 Guidry
2007/0074876 A1 4/2007 Pietras
2007/0095524 A1 * 5/2007 Lesko ..... 166/77.1

FOREIGN PATENT DOCUMENTS

WO WO2007/124418 A2 11/2007
WO WO2007/127737 A2 11/2007

* cited by examiner

TUBULAR RUNNING TOOL

BACKGROUND

The present invention relates to well drilling operations and, more particularly, to an apparatus for assisting in the assembly, disassembly and handling of tubular strings, such as casing strings, drill strings, and the like.

The drilling of subterranean wells involves assembling tubular strings, such as casing strings and drill strings, each of which comprises a plurality of elongated, heavy tubular segments extending downwardly from a drilling rig into a well bore. The tubular string consists of a number of tubular segments, which threadedly engage one another.

Conventionally, workers use a labor-intensive method to couple tubular segments to form a tubular string. This method involves the use of workers, typically a "stabber" and a tong operator. The stabber manually aligns the lower end of a tubular segment with the upper end of the existing tubular string, and the tong operator engages the tongs to rotate the segment, threadedly connecting it to the tubular string. While such a method is effective, it is dangerous (especially since both the "stabber" and the "tong operator" typically work on elevated platforms), cumbersome, and inefficient. Additionally, the tongs require multiple workers for proper engagement of the tubular segment and to couple the tubular segment to the tubular string. Thus, such a method is labor-intensive and therefore costly. Furthermore, using tongs can require the use of scaffolding or other like structures, which endangers workers.

Others have proposed a running tool, utilizing a conventional top drive assembly for assembling tubular strings. The running tool includes a manipulator, which engages a tubular segment and raises the tubular segment up into a power assist elevator, which relies on applied energy to hold the tubular segment. The elevator couples to the top drive, which rotates the elevator. Thus, the tubular segment contacts a tubular string and the top drive rotates the tubular segment and threadedly engages it with the tubular string.

While such a tool provides benefits over the more conventional systems used to assemble tubular strings, such a tool suffers from shortcomings. One such shortcoming is that the tubular segment might be scarred by the elevator dies. Another shortcoming is that a conventional manipulator arm cannot remove single joint tubulars and lay them down on the pipe deck without worker involvement.

Accordingly, it will be apparent to those skilled in the art that there continues to be a need for an apparatus that efficiently couples a tubular segment with a tubular string and handles the tubular string within the well bore utilizing an existing top drive. The present invention addresses these needs and others.

SUMMARY

The present invention provides an apparatus that moves a tubular segment from or to the v-door, couples the tubular segment with a tubular string, and handles the tubular string in a well bore.

An example of an apparatus of the present invention includes a tubular engagement assembly that connects to a drive shaft of a top drive. The tubular engagement assembly has a self-engaging ball and taper assembly that engages the tubular segment. The tubular engagement assembly connects to the drive shaft, such that rotation of the drive shaft causes rotation of the tubular segment as well. The apparatus may also have a single joint handling mechanism. This mechanism may have a remote controlled elevator hoist mechanism with elevator links and a manipulator arm to guide the tubular segment from the tubular delivery system to well center or from well center to the tubular delivery system.

An example of a method of the present invention includes providing the tubular segment, providing the top drive, providing the tubular engagement assembly, connecting the tubular engagement assembly to the drive shaft, picking up a tubular segment, connecting the tubular engagement assembly to the tubular segment using the ball and taper assembly, centralizing the tubular segment over the wellbore using a manipulator arm, lowering the top drive to bring the tubular segment into contact with the tubular string, and rotating the drive shaft so that the tubular segment engages the tubular string.

DETAILED DESCRIPTION

Figure 1:
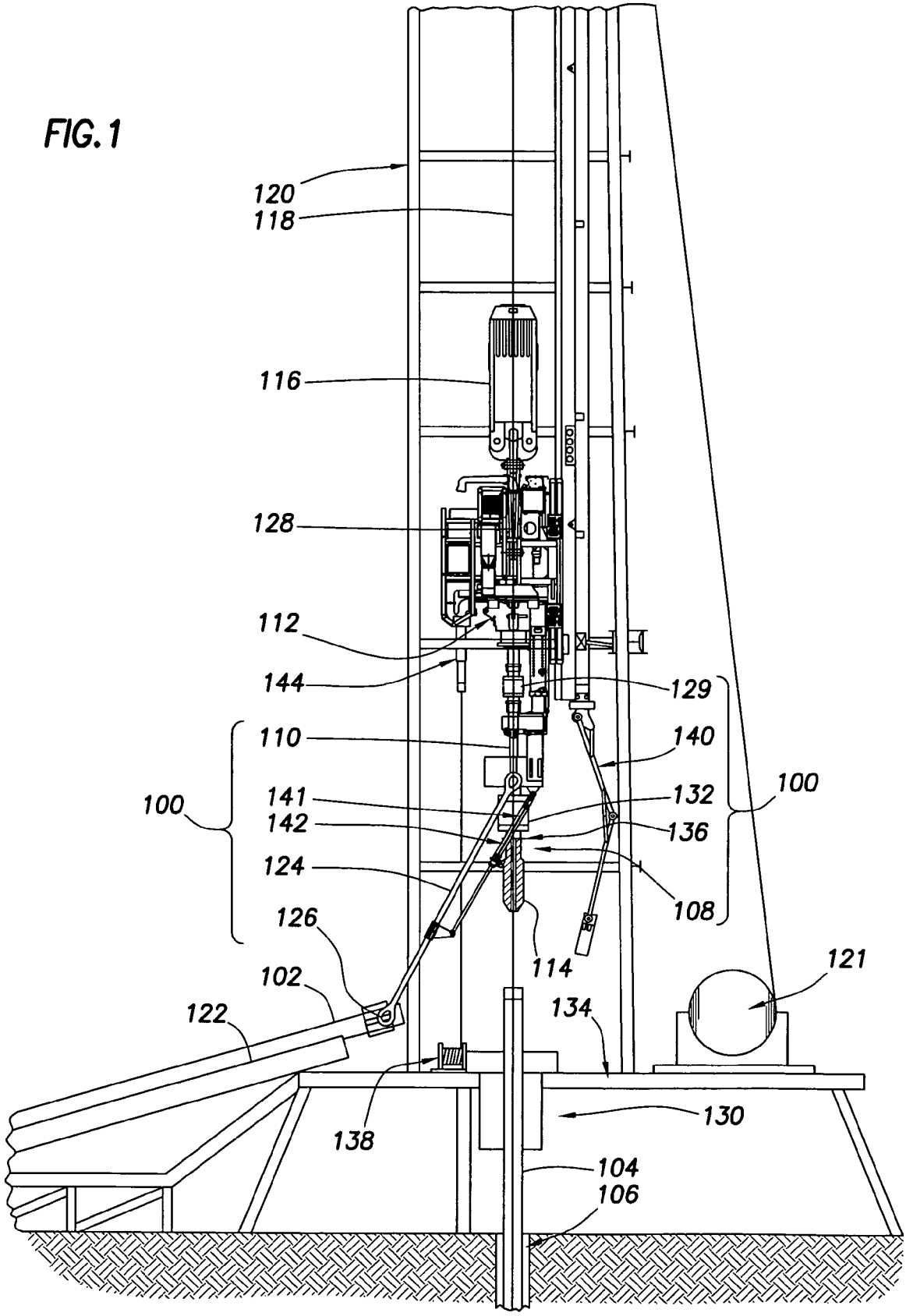
FIG. 1 is a side view showing one embodiment of a running tool in accordance the present invention.

Referring to FIG. 1, shown therein is a running tool 100 for handling a tubular segment 102, coupling the tubular segment 102 with a tubular string 104, and handling the tubular string 104 in a well bore 106. The running tool 100 has a tubular engagement assembly 108, which connects to a drive shaft 110 of a top drive 112. The tubular engagement assembly 108 has a ball and taper assembly 114, sized to releasably engage the tubular segment 102. The ball and taper assembly 114 engages the tubular segment 102, such that rotation of the drive shaft 110 results in a corresponding controlled rotation of the tubular segment 102.

The tubular running tool 100 may also include a block 116 connectable to the top drive 112. The block 116 is capable of engaging a plurality of cables 118, which connect to a rig drawworks or tubular string hoisting mechanism 121. The rig drawworks or tubular string hoisting mechanism 121 allows selective raising and lowering of the top drive 112 relative to a rig floor 134.

The tubular segment 102 is lifted from a tubular delivery system 122 via the block 116 connected to the top drive 112, using one or more elevator links 124 and an elevator hoist mechanism 126. The elevator hoist mechanism 126 may be equipped with two hinged side doors that open and close when handling the tubular segment 102. The side doors will have a safe lock mechanism to secure the tubular segment 102 in the elevator hoist mechanism 126. Alternatively, a standard elevator hoisting mechanism may be used. The elevator links 124 and the elevator hoist mechanism 126 hoist the tubular segment 102 until the tubular is vertical, aligning with the well bore and running tool 100. The manipulator arm 140 assists with the alignment of the tubular segment 102 at its lower end. The elevator hoist mechanism 126 may operate hydraulically or pneumatically. The elevator links 124 have at least one hydraulic cylinder 141 to control the angle of the elevator links 124.

Figure 2B:
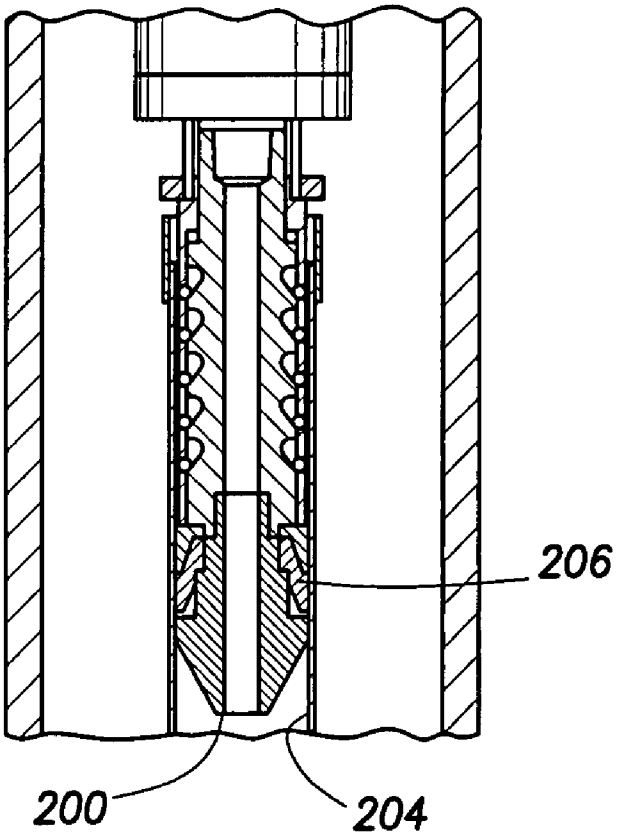
FIG. 2B is a partial side view of one embodiment of an internal tubular engagement assembly in accordance with the present invention.
Figure 2A:
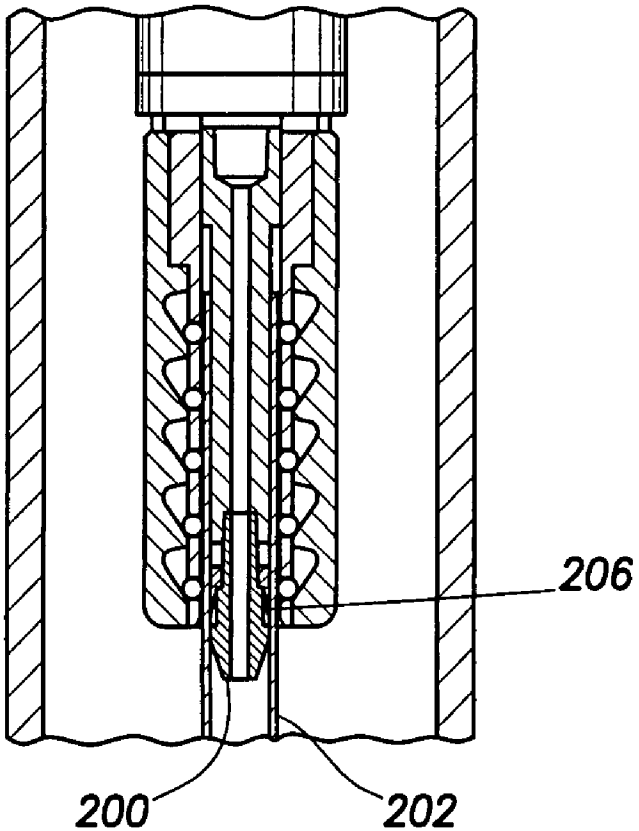
FIG. 2A is a partial side view of one embodiment of an external tubular engagement assembly in accordance with the present invention.
Figure 5:
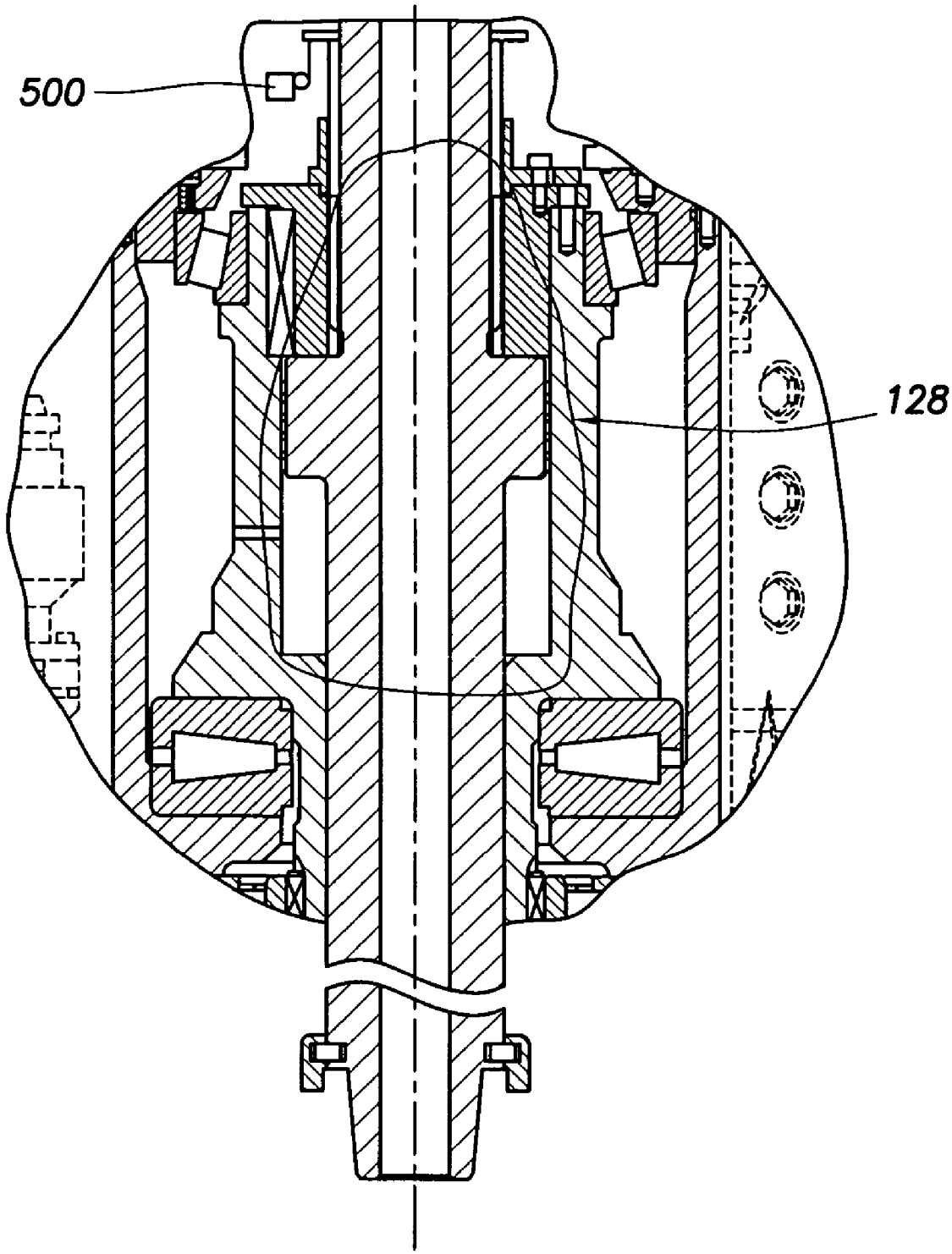
FIG. 5 is a cut-away view of the compensator assembly.

The top drive 112, with the corresponding tubular engagement assembly 108 and the tubular segment 102 still connected to the elevator hoist mechanism 126, descends until the threads at the bottom of the tubular segment 102 align with threads at the top of the tubular string 104, which is present in the well bore 106. Since the top drive 112 is very heavy, it may have a compensator 128 to ensure that only the weight of the tubular segment 102 and the drive shaft 110 rests on the threads. This prevents cross threading or shearing of the threads. Alternatively, if the top drive 112 does not have the capability to properly compensate, an external compensator 129, working in a similar fashion as described above, can be added to the bottom of the top drive 112. The compensator 128 or 129 may include an indicator 500 (shown in FIG. 5) to show the position of the external compensator 129 or compensator 128. A stationary or rotating slip or spider 130 supports the tubular string 104 in the well bore 106 when the top drive 112 is not connected to the tubular string 104. The slip or spider 130 may engage the tubular string 104 using a ball and taper assembly much like the ball and taper assembly 114 of the tubular engagement assembly 108. Once the tubular segment 102 is supported by the tubular string 104, the top drive 112 continues to be lowered, until the tubular engagement assembly 108 engages the tubular segment 102. In order to facilitate this engagement, the running tool 100 may include a stabbing guide 200 (shown in FIGS. 2A and 2B). The stabbing guide 200 centralizes the tubular segment 102 about the tubular engagement assembly 108. While the stabbing guide 200 may be in any location, it is desirably on the bottom of the tubular engagement assembly 108.

Once the threads at the top of the tubular string 104 align with the threads at the bottom of the tubular segment 102, and the tubular engagement assembly 108 is fully inserted, the downward motion of the top drive 112 ceases, the tubular engagement assembly 108 engages and the top drive 112 is operated such that the drive shaft 110 turns. The turning of the drive shaft 110 results in controlled rotation of the tubular engagement assembly 108, and thus the tubular segment 102. During this time, the slip or spider 130 prevents the tubular string 104 from rotating. As the drive shaft 110 turns, the tubular segment 102 connects to and becomes part of the tubular string 104. Resultantly, the top drive 112 can support the suspended load of the entire tubular string 104, and the slip or spider 130 can be disengaged. At this point, the top drive 112 can operate to lift, rotate, lower, or perform any other operations typical with the tubular string 104. If the tubular string 104 is incomplete, the block 116 may lower the top drive 112, thus lowering the tubular string 104 into the well bore 106. This lowering may provide clearance for adding an additional tubular segment 102 to the tubular string 104. Before an additional tubular segment 102 is added, the slip or spider 130 re-engages the tubular string 104 to provide support. The top drive 112 is then detached from the tubular string 104, so that it is free to attach to the next tubular segment 102. The slip or spider 130 holds the tubular string 104 in place until the addition of the next tubular segment 102. After the tubular segment 102 becomes part of the tubular string 104, the top drive 112 may again support the tubular string 104, and the slip or spider 130 can again be released. The process repeats until the tubular string 104 reaches the desired length. A load plate 136 allows the tubular string 104 to be pushed into the well bore 106. If the weight of the top drive 112 is not sufficient to push the tubular string 104 into the well bore, a wireline winch pull down mechanism 138 or hydraulic cylinder assembly 144 maybe attached to the top drive 112 to impart additional downward force to the tubular string 104 via top drive 112 and load plate 136.

The tubular engagement assembly 108 desirably includes a seal assembly 206 to enable pressure and fluid flow between the drive shaft 110 and the tubular string 104. This allows for a sealed central fluid flow path from the top drive 112 to the tubular string 104 in the well bore 106, without the need to remove the tubular engagement assembly 108. The resulting flow may be pressurized or non-pressurized, depending on conditions at the site. Providing fill-up capability in the tubular string 104 allows functions such as adding fluid to the annulus of the tubular string 104 while running the tubular string 104 into the well bore 106 or cementing to take place through the tubular string 104, once the tubular string 104, has been run into the well bore 106. This may occur by placing a cementing head 132 above the tubular engagement assembly 108. Placing the cementing head 132 in this location prior to running the tubular string 104 into the well bore 106 also prevents some difficulties occurring when the tubular string 104 ends above the rig floor 134. Additionally, this placement allows for vertical movement, rotation or torquing of the tubular string 104 in the well bore 106 while completing a cementing operation. While the advantages of placing the cementing head 132 above the tubular engagement assembly 108 are apparent, the cementing head 132 may still rest below the tubular engagement assembly 108.

The ball and taper assembly 114 may be any shape. However, the ball and taper assembly 114 is desirably cylindrical with a centerline aligning generally with a centerline of the tubular segment 102. The ball and taper assembly 114 may engage the tubular segment 102 at either an outer surface 202 (shown in FIG. 2A) or an inner surface 204 (shown in FIG. 2B) of the tubular segment 102, depending on the diameter of the tubular segment 102. In order to accommodate different diameters, the ball and taper assembly 114 is desirably interchangeable with other ball and taper assemblies, depending on specific operational requirements. Generally, smaller diameter tubular segments 102 will require engagement at the outer surface 202 and larger diameter tubular segments 102 will require engagement at the inner surface 204. However, selection of the ball and taper assembly 114 may vary as site conditions dictate.

Figure 3:
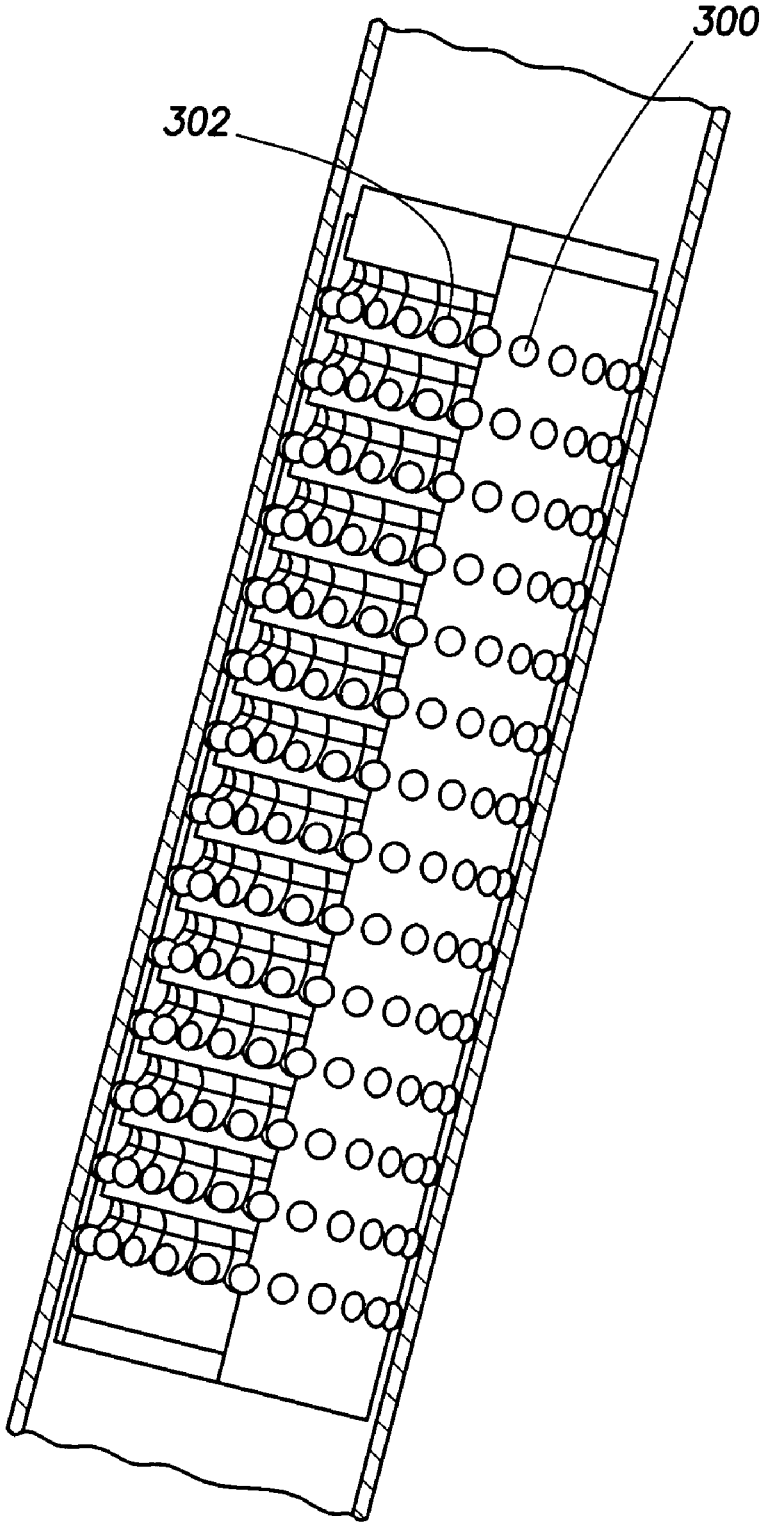
FIG. 3 is a cutaway side view of one embodiment of a ball and taper assembly in accordance with the present invention.

The ball and taper assembly 114 is self-engaging. That is, it has a self-energizing engagement. To engage the tubular segment 102, the ball and taper assembly 114 uses friction. As shown in FIG. 3, a plurality of balls 300 are generally contained within a plurality of tapers 302, which are disposed about the ball and taper assembly 114. While some tapers may be oriented in a generally vertical alignment, others may be oriented in a generally horizontal or any other alignment. Referring now to FIG. 4, the tapers 302 have at least one widened section 400 and at least one constricted section 402. The tapers 302 may be any shape, so long as they have the widened section 400 and the constricted section 402. While the figures show spherical balls 300, the balls 300 may also be elongated, resembling rollers, or the balls 300 may be any other suitable shape.

Figure 4A:
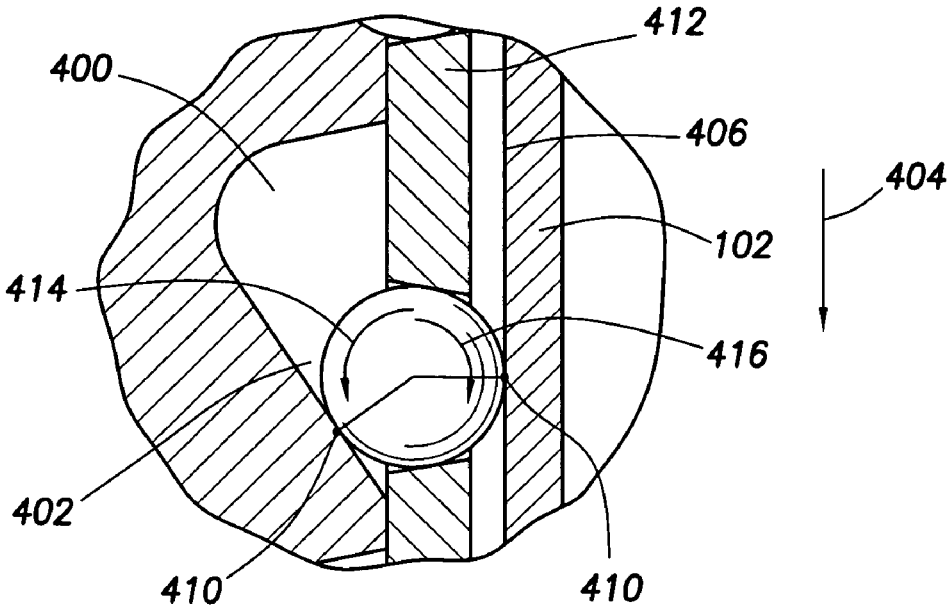
FIG. 4A is a cross sectional side view the ball and taper assembly of FIG. 3, wherein a ball is in a constricted section of a taper.
Figure 4B:
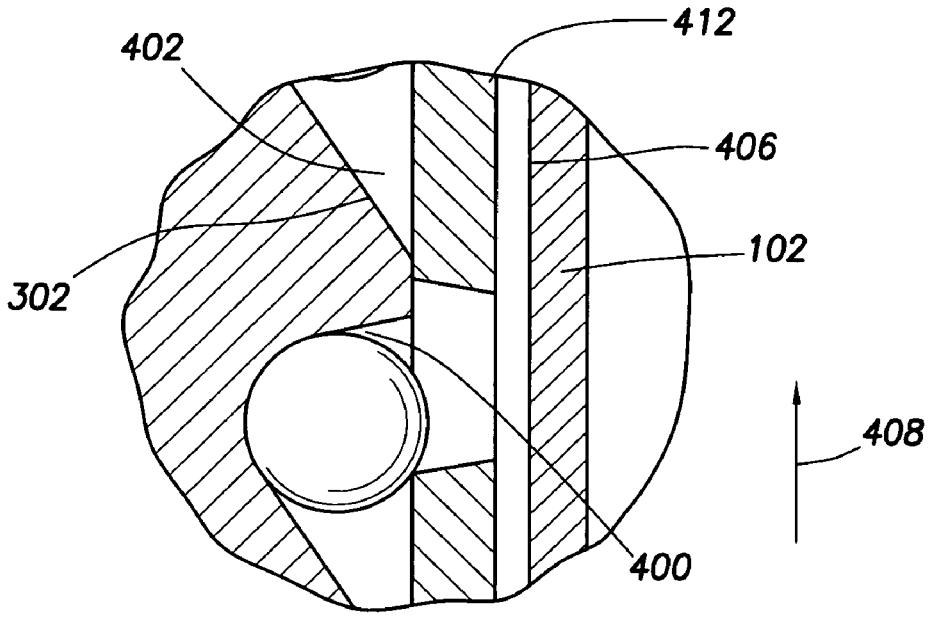
FIG. 4B is another cross sectional side view the ball and taper assembly of FIG. 3, wherein a ball is in a widened section of a taper.

The balls 300, due to gravity and the weight of the sleeve 412, are typically in the constricted section 402. When the ball and taper assembly 114 moves in a first direction 404 toward the tubular segment 102, a wall 406 of the tubular segment 102 pushes the balls 300 toward the widened section 400 of the tapers 302 (causing the balls 300 to partially move in a first rotation 414), allowing free passage of the tubular segment 102, as shown in FIG. 4A. Depending on the diameter of the tubular segment 102, the wall 406 may correspond to the inner surface 204 (shown in FIG. 2B), or to the outer surface 202 (shown in FIG. 2A). When the ball and taper assembly 114 moves in a second direction 408 (causing the balls 300 to move in a second rotation 416) friction between the balls 300, tapers 302 and the wall 406 will fully engage the ball and taper assembly 114 with the tubular segment 102, as shown in FIG. 4A.

When the balls 300 are in the constricted section 402, any additional force in the second direction 408 acting on the ball and taper assembly 114 translates into a compressive force at contact points 410. However, the balls 300 may only impart small peen marks during engagement. This is very different from traditional slip dies, which scar the contact surface of the tubular segment 102. The drawback of scarring is that it creates stress risers in the tubular segment 102 which may result in propagation of cracks.

The tapers 302 may have a shape that allows the balls 300 to move along more than one axis. Additionally, the tapers 302 have widened 400 and constricted 402 sections. Since there are pluralities of possible contact points 410 within any given taper 302, the grip of the ball and taper assembly 114 may be effective in more than one direction. Depending on the shape of the tapers 302, the ball and taper assembly 114 may provide support to a gravitational load, prevent relative rotation in clockwise or counterclockwise direction, or simultaneously support a load and resist relative rotation. Additionally, the ball and taper assembly 114, may allow for some upward loads to be resisted by the running tool 100. This may be accomplished through the use of a fail safe locking mechanism 142 and load plate 136. This is particularly useful when pushing the tubular string 104 into the well bore 106. For this, load plate 136 may allow downward force to transfer to the tubular string 104. Additionally, wireline winch pull down mechanism 138 or hydraulic cylinder assembly 144 may be attached to the top drive 112, in order to impart additional downward force on the running tool 100 and force the tubular string 104 into the well bore 106.

The ball and taper assembly 114 may have both static and dynamic load bearing capability. This allows the ball and taper assembly 114 to carry the full weight of the tubular string 104 while rotating and lowering into or raising out of the well bore 106. The ball and taper assembly 114 is capable of withstanding the torque involved in make up and break out, allowing the tubular segment 102 to be added to or removed from the tubular string 104 without the need for tongs. Additionally, the ball and taper assembly 114 may provide support and/or prevent movement in any number of other directions.

Figure 4C:
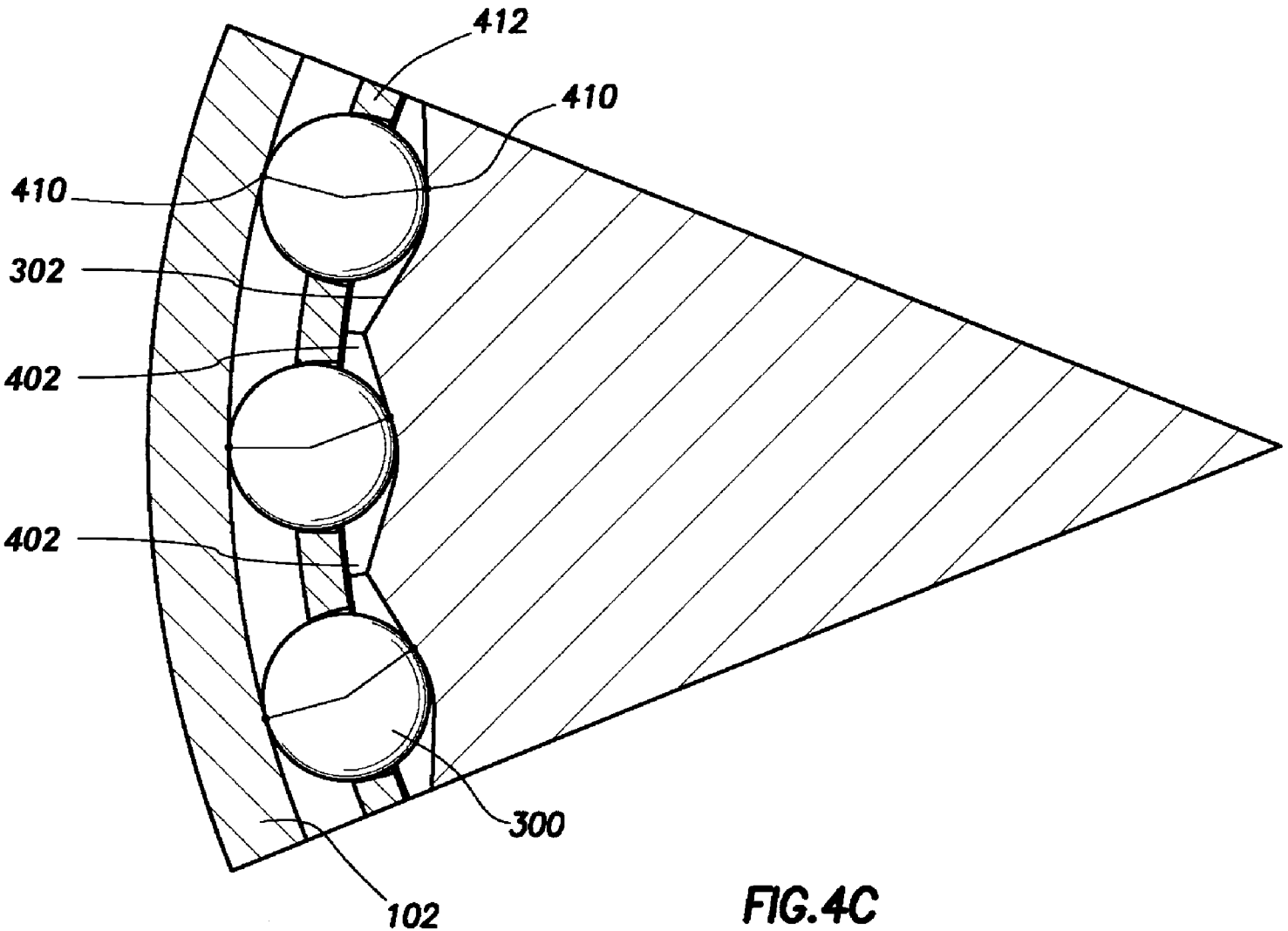
FIG. 4C is a cross sectional top view of the ball and taper assembly of FIG. 3.

Simultaneously preventing movement in multiple directions can be done in at least two ways. Multiple single-direction balls and tapers may have different orientations. For example, one ball and taper may be situated vertically on the ball and taper assembly 114, while another ball and taper may be situated horizontally on the ball and taper assembly 114. This allows each ball and taper to resist movement in a single direction. Alternatively, a single ball and taper may be configured to prevent movement in multiple directions. As shown in FIG. 4C, the taper 302 can be shaped so as to have more than one constricted section 402. The ball and taper assembly 114 shown in FIG. 4C may prevent movement in at least two directions. Combining the views of FIGS. 4A, 4B, and 4C results in a multi-direction ball and taper, which can prevent movement in at least three directions (rotation to the right, rotation to the left, and pulling the ball and taper assembly 114 upward). The shape of the tapers 302 may be modified in any number of ways, depending on the expected directions of loads, the materials used, the radius of the balls 300, the radius of the wall 406 to be gripped. For example, a pseudo-dome shape may be used for the taper 302.

In order to release the engagement between the tubular segment 102 and the ball and taper assembly 114, a sleeve 412 (shown in FIGS. 4A and 4B) may be used. The sleeve 412 fits between the tubular segment 102 and the ball and taper assembly 114, and extends due to gravity, allowing engagement between the tubular segment 102 and the ball and taper assembly 114. When forcefully retracted, the sleeve 412 serves to disengage the ball and taper assembly 114 by preventing the ball and taper assembly 114 from engaging the tubular segment 102. While engagement of the balls is a self-energizing process, the failsafe locking mechanism 142 with a powered unlock is desirable for disengagement. Therefore, disengagement may use hydraulics, pneumatics, or any other power source readily available at the site. In order to prevent premature disengagement, the ball and taper assembly 114 desirably has the failsafe locking mechanism 142 that keeps the sleeve 412 in an extended position until disengagement is desired.

Prior to disengagement, the ball and taper assembly 114 may move slightly in the first direction 404, such that the compressive force at the contact points 410 diminishes. The sleeve 412 may then move more easily between the tubular segment 102 and the ball and taper assembly 114 in the second direction 408, thereby blocking the ball and taper assembly 114 from gripping the tubular segment 102. The ball and taper assembly 114 then moves in the second direction 408 away from tubular string 104.

While the use of the running tool 100 for coupling has been discussed, it should be understood that one skilled in the art could similarly use the running tool 100 for uncoupling with minor changes. Additionally, while movement of the ball and taper assembly 114 relative to the tubular segment 102 is disclosed, the tubular segment 102 may move relative to the ball and taper assembly 114 with the same general result.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. An apparatus for handling a tubular segment, coupling or uncoupling the tubular segment with a tubular string, and handling the tubular string in a well bore, comprising:

a tubular engagement assembly connectable to a drive shaft of a top drive, the tubular engagement assembly having a self-engaging ball and taper assembly sized to releasably engage the tubular segment;

wherein, when the tubular engagement assembly connects to the drive shaft and the ball and taper assembly engages the tubular segment, rotation of the drive shaft results in a corresponding rotation of the tubular segment, with minimal relative rotation between the tubular engagement assembly and the tubular segment;

wherein the tubular engagement assembly is capable of withstanding the torque involved in rotating the tubular string in the well bore and the torque required to make up or breakout a tubular segment; and wherein the ball and taper assembly has both static and dynamic load bearing capability configured to carry the full weight of the tubular string while simultaneously rotating and vertically moving the tubular string within the well bore.

2. The apparatus of claim 1, further comprising the top drive having the drive shaft.

3. The apparatus of claim 2 wherein the top drive has a compensator such that only the weight of the tubular segment and the drive shaft is on threads during coupling of the tubular segment with the tubular string.

4. The apparatus of claim 1, further comprising an external compensator assembly such that only the weight of the tubular segment and the drive shaft is on threads during coupling of the tubular segment with the tubular string.

5. The apparatus of claim 3, further comprising an indicator to show the position of the compensator assembly.

6. The apparatus of claim 4, further comprising an indicator to show the position of the compensator assembly.

7. The apparatus of claim 1 wherein the tubular engagement assembly further comprises a stabbing guide to ensure that the tubular centralizes as the tubular engagement assembly engages it.

8. The apparatus of claim 1 wherein the tubular engagement assembly further comprises a seal to maintain pressure and fluid flow between the drive shaft and the tubular string.

9. The apparatus of claim 1 wherein the ball and taper assembly is generally cylindrical.

10. The apparatus of claim 1 wherein the sizing of the ball and taper assembly permits it to engage an inner or outer surface of the tubular segment.

11. The apparatus of claim 1, wherein the ball and taper assembly has a failsafe locking mechanism capable of preventing premature disengagement.

12. The apparatus of claim 1, wherein the ball and taper assembly has a powered unlock for disengagement from the tubular segment.

13. The apparatus of claim 1, wherein the ball and taper assembly is interchangeably replaceable with another ball and taper assembly sized to accommodate a different tubular diameter.

14. The apparatus of claim 1 wherein the tubular engagement assembly is capable of withstanding the compressive force involved in pushing the tubular string into the well bore.

15. The apparatus of claim 1 wherein the tubular engagement assembly is capable of withstanding the tensile force involved in supporting the tubular string in the well bore.

16. The apparatus of claim 1 wherein the tubular engagement assembly is capable of simultaneously withstanding a compressive force.

17. The apparatus of claim 1 wherein the tubular engagement assembly is capable of simultaneously withstanding a tensile force.

18. The apparatus of claim 1 wherein a manipulator arm guides the tubular segment between a delivery system and the well bore.

19. The apparatus of claim 1 wherein an elevator hoist mechanism, a manipulator arm and elevator links hoist the tubular segment until it aligns over the well bore.

20. The apparatus of claim 1 wherein the tubular segment may be guided back to a delivery system upon removal from the tubular string.

21. The apparatus of claim 19, wherein the elevator hoist mechanism has two hinged doors that open and close with lock safe mechanism when handling the tubular segment.

22. An apparatus for handling a tubular segment, coupling or uncoupling the tubular segment with a tubular string, and handling the tubular string in a well bore, comprising:

a top drive having a drive shaft and a compensator, such that only the weight of the tubular segment and the drive shaft is on threads during coupling of the tubular segment with the tubular string;

a tubular engagement assembly connectable to the drive shaft of the top drive, the tubular engagement assembly having an interchangeable, cylindrical, self-engaging ball and taper assembly with a hydraulic or pneumatic systems controlled powered unlock, and a failsafe locking mechanism, the ball and taper assembly being sized to releasably engage a surface of the tubular segment and a seal to maintain pressure and fluid flow between the drive shaft and the tubular string; and a stabbing guide to ensure that the tubular centralizes as the tubular engagement assembly engages it;

wherein, when the tubular engagement assembly connects to the drive shaft and the ball and taper assembly engages the tubular segment, rotation of the drive shaft results in a corresponding rotation of the tubular segment, with minimal relative rotation between the tubular engagement assembly and the tubular segment, and the tubular engagement assembly is capable of withstanding compressive force, tensile force, and torque involved in tubular string operations; and wherein the ball and taper assembly has both static and dynamic load bearing capability configured to carry the full weight of the tubular string while simultaneously rotating and vertically moving the tubular string within the well bore.

23. A method for coupling a tubular segment with a tubular string, the method comprising the steps of:

providing the tubular segment;

providing a top drive having a drive shaft;

providing a tubular engagement assembly connectable to the drive shaft of the top drive, the tubular engagement assembly having a self-engaging ball and taper assembly sized to releasably engage the tubular segment;

connecting the tubular engagement assembly to the drive shaft;

connecting the tubular engagement assembly to the tubular segment using the ball and taper assembly;

centralizing the tubular segment over the well;

providing the tubular string;

lowering the top drive to bring the tubular segment into contact with the tubular string; and rotating the drive shaft such that the tubular segment engages the tubular string;

wherein the tubular engagement assembly is capable of withstanding the torque involved in rotating the tubular string in the well bore and the torque required to make up or breakout a tubular segment; and wherein the ball and taper assembly has both static and dynamic load bearing capability configured to carry the full weight of the tubular string while simultaneouslv rotating and vertically moving the tubular string within the well bore.

24. The method of claim 23, wherein the tubular engagement assembly also has a compensator to minimize the weight applied to the thread of the tubular segment and a manipulator assembly to guide the tubular to be aligned with the tubular string or to guide the tubular segment back to a delivery system for lay down purposes.

25. A method for uncoupling a tubular segment with a tubular string, the method comprising the steps of:

providing the tubular string, including the tubular segment;

providing a top drive having a drive shaft;

providing a tubular engagement assembly connectable to the drive shaft of the top drive, the tubular engagement assembly having a self-engaging ball and taper assembly sized to releasably engage the tubular segment;

connecting the tubular engagement assembly to the drive shaft;

lowering the top drive to bring tubular engagement assembly into contact with tubular segment of the tubular string;

connecting the tubular engagement assembly to the tubular segment using the ball and taper assembly; and rotating the drive shaft such that the tubular segment disengages the tubular string;

wherein the tubular engagement assembly is capable of withstanding the torque involved in rotating the tubular string in the well bore and the torque required to make up or breakout a tubular segment; and wherein the ball and taper assembly has both static and dynamic load bearing capability configured to carry the full weight of the tubular string while simultaneously rotating and vertically moving the tubular string within the well bore.

26. The method of claim 25, wherein the tubular engagement assembly also has a compensator to minimize the weight applied to the thread of the tubular segment and a manipulator assembly to guide the tubular to be aligned with the tubular string or to guide the tubular segment back to a delivery system for lay down purposes.

27. An apparatus for handling a tubular segment, comprising:

a tubular engagement assembly haying a self-engaging ball and taper assembly sized to releasably engage the tubular segment;

wherein the ball and taper assembly comprises a plurality of balls within a plurality of a single-direction tapers, wherein the plurality of single-direction tapers are oriented in at least two different directions;

wherein the tubular engagement assembly is capable of withstanding the torque involved in rotating a tubular string in a well bore and the torque required to makeup or breakout the tubular segment; and wherein the ball and taper assembly has both static and dynamic load bearing capability configured to carry the full weight of the tubular sting while simultaneously rotating and vertically moving the tubular string within the well bore.

28. An apparatus for handling a tubular segment, comprising:

a tubular engagement assembly having a self-engaging ball and taper assembly sized to releasably engage the tubular segment;

wherein the ball and taper assembly comprises a plurality of balls within a plurality of a multi-direction tapers;

wherein the tubular engagement assembly is capable of withstanding the torque involved in rotating a tubular string in a well bore and the torque required to make up or breakout the tubular segment; and wherein the ball and taper assembly has both static and dynamic load bearing capability configured to carry the full weight of the tubular string while simultaneously rotating and vertically moving the tubular string within the well bore.

* * * * *

UNITED STATES PATENT AND TRADEMARK OFFICE

CERTIFICATE OF CORRECTION

PATENT NO. : 7,445,050 B2
APPLICATION NO. : 11/410733
DATED : November 4, 2008
INVENTOR(S) : Beat Kuttel et al.

It is certified that error appears in the above-identified patent and that said Letters Patent is hereby corrected as shown below:

On Title Page, Item (75): Please change the name of the first named inventor from "B. Beat Kuttel" to "Beat Kuttel".

Signed and Sealed this

Thirtieth Day of June, 2009

JOHN DOLL
*Acting Director of the United States Patent and Trademark Office*